United States Patent [19]

Enzmann

[11] 4,406,239

[45] Sep. 27, 1983

[54] SAILBOATS, ESPECIALLY CATAMARANS

[76] Inventor: Klaus Enzmann, Am Kirchenhölzl 5, D-8032 Gräfelfing, Fed. Rep. of Germany

[21] Appl. No.: 351,690

[22] Filed: Feb. 24, 1982

Related U.S. Application Data

[63] Continuation of Ser. No. 83,717, Oct. 11, 1979, abandoned.

[30] Foreign Application Priority Data

Oct. 13, 1978 [DE] Fed. Rep. of Germany ..... 2844766
Oct. 13, 1978 [DE] Fed. Rep. of Germany ..... 2844767
Feb. 26, 1979 [DE] Fed. Rep. of Germany ..... 2907518

[51] Int. Cl.[3] ..... B63B 35/38; B63B 3/16; B63B 15/02; B63H 25/06

[52] U.S. Cl. ..... 114/39; 114/61; 114/90; 114/162; 114/165; 403/292

[58] Field of Search ..... 114/90, 102, 108, 39, 114/61, 162, 165, 109, 292, 283, 357, 344; 403/292, 293, 109, 353; 248/499; 410/81, 82, 55; 296/40; 24/201 A; 440/100; 441/74

[56] References Cited

U.S. PATENT DOCUMENTS

| | | | |
|---|---|---|---|
| 748,960 | 1/1904 | Lamb | 114/102 |
| 2,410,245 | 10/1946 | Scrivener et al. | 403/293 |
| 2,712,293 | 7/1955 | O'Higgins | 114/61 |
| 2,748,740 | 6/1956 | Villar | 114/61 |
| 2,815,852 | 12/1957 | Harrer | 403/292 X |
| 2,893,339 | 7/1959 | Ram | 114/102 X |
| 3,050,751 | 8/1962 | Moon | 441/74 |
| 3,208,421 | 9/1965 | Landes et al. | 114/292 X |
| 3,613,136 | 10/1971 | Cogliano | 114/344 |
| 3,656,445 | 4/1972 | Padwick | 114/39 |
| 3,865,061 | 2/1975 | Newman | 114/61 |

FOREIGN PATENT DOCUMENTS

| | | | |
|---|---|---|---|
| 270890 | 2/1965 | Australia | 114/90 |
| 1050918 | 12/1966 | United Kingdom | 114/90 |

*Primary Examiner*—Sherman D. Basinger
*Attorney, Agent, or Firm*—Jim Zegeer

[57] ABSTRACT

A sailboat of the catamaran type has a pair of hulls joined by a pair of wedge shaped crossbeams, the crossbeams geometry being oriented to provide balanced distribution of loading on the hulls and crossbeams. An easily dismantable, multipart mast is stepped on the forward crossbeam and has a hook engaged by a ring or the like which is coupled to the shrouds and stay cables. The opposited ends of these cables has a unique "T" member for quick coupling with slotted shroud and stay anchor plates on the hulls of the boat. The rudder assembly includes an extruded rudder blade mounted in a rudder guide for vertical movement such that it is automatically raised upon encountering an obstruction.

28 Claims, 12 Drawing Figures

FIG.3
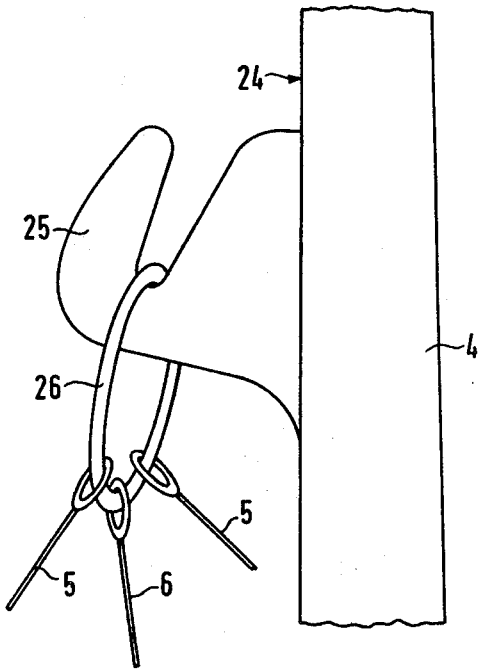
FIG.4
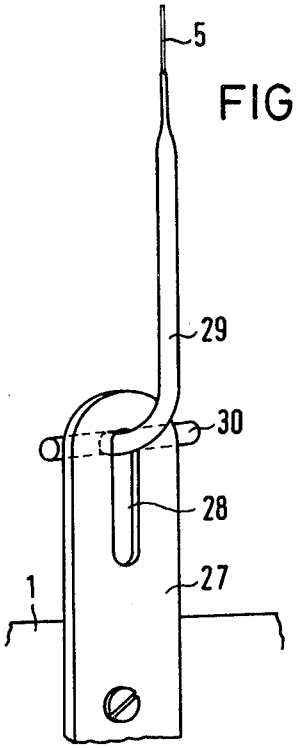
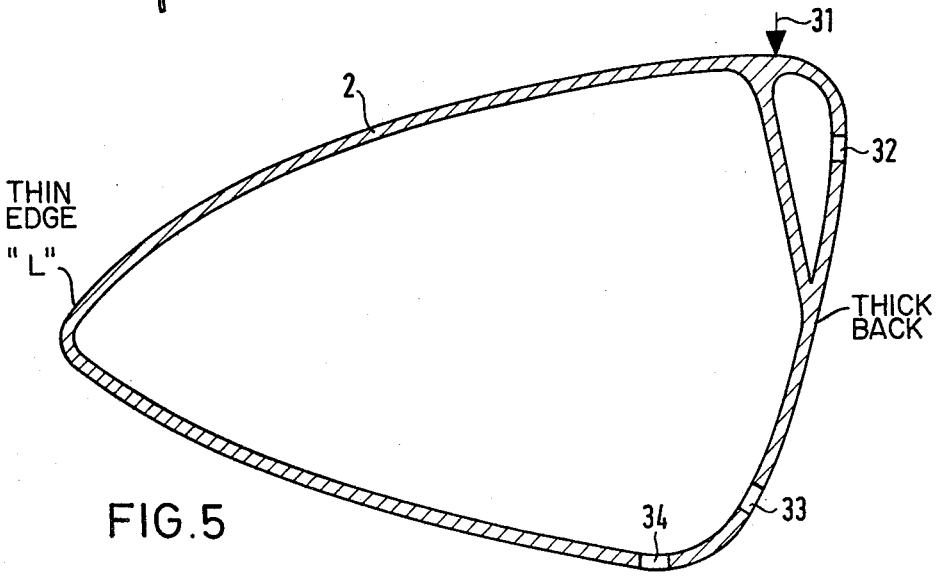
FIG.5

SAILBOATS, ESPECIALLY CATAMARANS

This is a continuation of application Ser. No. 083,717, filed Oct. 11, 1979 "Improvements In Sailboats Especially Catamarans" now abandoned.

The present invention relates to improvements in sailboats, and especially improvements in catamarans.

During the last few years, interest in sailing as a sport has increased considerably. This interest in sport-sailing has pushed a type of boat, namely the catamaran, more strongly into the foreground. The known catamarans, however, are relatively unsuited for a greater spread of this type of boat, since on the one hand they are quite expensive and on the other hand require a considerable expenditure for the transportation and assembly of the boat.

The object of the present invention therefore is to provide safely functioning, esthetically appealing, compact and easily transportable catamaran at a favorable price, which can be easily disassembled and assembled, which is of great strength and may be safely maneuverable even in case of heavier loads and especially in shallow waters.

FEATURES OF THE INVENTION

According to the invention, the hulls of the catamaran are spaced by fore and aft wedge shaped crossbeams, the forward crossbeam having a unique multi part mast stepped thereon, and a rudder, translated vertically automatically upon encountering an obstruction.

The dismantling of the mast considerably facilitates the transportation of the catamaran of the invention. The advantageous developments of the mast of the invention make possible a simple dismantling or mounting of the mast without making too high, and thus expensive, requirement of the production tolerances of the critical individual parts of the mast, particularly of the inside pipe, and without reducing the strength of the mast in an inadmissible manner.

The accomodation according to the invention of shrouds, head stay, trapezoidal wires etc., in a hook fastened to the mast and the fastening according to the invention of the shroud to the anchor plate by means of a rod-like terminal piece insertable in the anchor plate through an ablong hole, make it possible even for a layman to quickly make the catamaran ready for sailing without difficulties and, by the same token to disassemble it quickly and easily for transportation and or storage.

As a result of the wedge bracing of the crossbeams in the hulls, according to the invention, great strength of the catamaran is achieved in a simple manner. This strength is increased still by the cost-favorable use of the same profile for the forward and rear crossbeam, whereby the rear crossbeam is turned about 180° in relation to the forward crossbeam, since as a result of the compression stress of the forward crossbeam by the mast and the tension load of the rear crossbeam by the main sail sheet a balanced distribution of the loads occuring, on the hulls and crossbeams takes place, so that even in case of maximum loads there will be no danger of breaking.

As a result of the vertical adjustability of the rudder blade of the invention, a large surface of the rudder blade with a constant lever arm for the steering process is available even in shallow waters, especially preferred by catamaran sailors, in which the rudder blade is pulled up a little, so that neither the maneuverability of the catamaran will be impeded in such shallow waters nor is there any danger of breaking the rudder blade.

The hulls, in case of the catamaran of the invention, advantageously consist of two lateral parts, which on their sides are connected by a one-piece cover. The one-piece development of the cover simplifies the production of the hull and has fewer disadvantages, as a result of which the hull becomes stronger, more compact and esthetically more attractive.

According to an advantageous embodiment of the catamaran of the invention, a profile for the mounting and guiding of the crossbeam, directed into the inside of the hull and always adapted to the profile of the crossbeam has been developed in one piece with the lateral parts. This development of the reception of the crossbeams, is simplier to produce as compared to known developments, where several separate parts are required, since the profiles may be shaped simultaneously with the lateral parts. Beyond that, the mounting for the crossbeams according to the invention is more robust, operationally safer and esthetically more attractive.

Another effective further development of the catamaran of the invention consists in the fact, that the trampolin consists of at least two longitudinally divided and crossdirectionally mutually guyed parts. As a result of this development of the trampolin according to the invention, which preferably is bound with the help of bolt ropes on the hulls and crossbeams, the hulls of the catamaran are prestressed against a movement to the outside in a simple manner, without additional separate elements.

Finally, according to the invention, provision has been made, for a separate box to be provided in the rear part of at least one of the hulls, whereby the box and the rear-end section of the hull may be reached by way of a closeable opening in the cover. This makes possible, in a simple manner the safe stowing away of personal effects in the box by way of a single opening in the hull and moreover, the pumping out of water from the end of the hull.

BRIEF DESCRIPTION OF THE DRAWINGS

Additional advantages, characteristics and possibilities of application of this invention will result from the following description of embodiments in connection with the drawings.

FIG. 3 is an enlarged view of the hook suspension of shrouds, head stay etc., shown in the circle III in a borken line, in FIG. 1., FIG. 4 is an enlarged side view of the anchor plate-shrouds-connection, shown in the dash-dot line circle IV, in FIG. 1., FIG. 5 shows the cross-sectional profile of the crossbeams.

FIG. 1 shows a catamaran with two hulls 1, forward crossbeam 2, and rear or aft crossbeam 3, mast 4, shrouds 5, head stay 6 and rudder blade 7.

DETAILED DESCRIPTION

Figure 2:
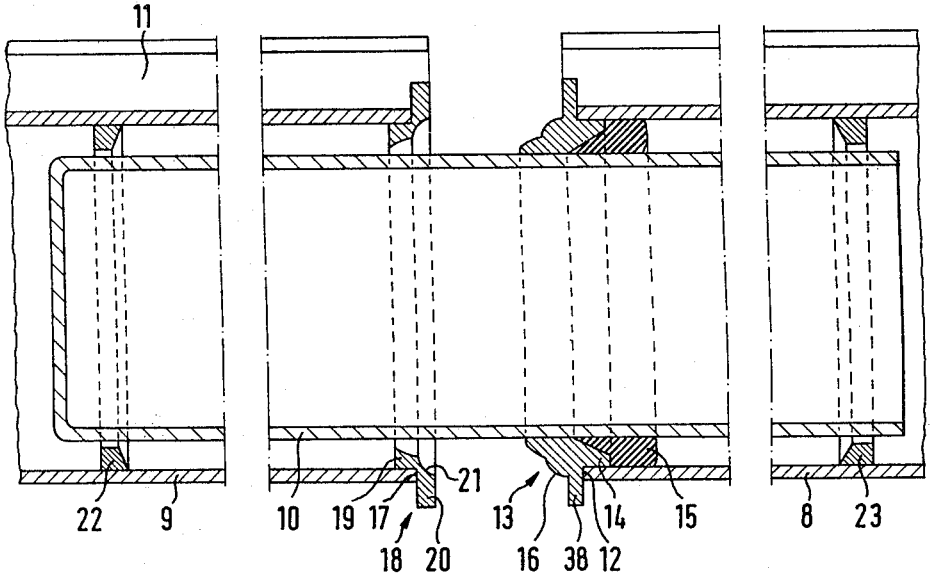
FIG. 2 shows a partial longitudinal cut through not completely assembled mast.

FIG. 2 shows details of the collapsible mast 4. The mast 4 includes an upper pipe section 8, a lower pipe section 9 and an inner pipe 10. The pipe section 8, and 9 have on their rear end a rail guide or slot 11 for the attachment of the sail. At the lower end 12 of the upper pipe section 8 is a nesting ring 13, attached by a press fit of its projection 14, projecting into the inside of the pipe section 8. The ring 13 may also be attached by adhesion, rivetting etc., to the pipe section 8. The closed inside pipe 10 is held by press fit and/or other means of attachment such as adhesion, rivetting etc., in the ring 13. In order to accomplish a watertight closure of the inside of the upper pipe section 8, by which a capsizing of the catamaran is prevented, sealing material 15 is disposed behind the ring 13, in the inside of the pipe section 8, between said pipe section 8 and the inside pipe 10. The ring 13 has a flange 38, which serves as protection for the box for the upper pipe section 8. The ring 13 has an outward arching, convex area 16 on the side facing the lower pipe section 9.

Nesting ring 18, having a surface complementary to the surface of ring 13, has been fastened at the upper end 17 of the lower pipe section 9, with a projection 19 projecting into the inside of the lower pipe section, and with a flange 20 which can mate with flange 38. This fastening may be accomplished at the upper pipe section 8 by adhesion, rivetting etc., corresponding to the fastening of the ring 13 in upper pipe section 8. As noted above ring 18 has an inward arched, concave area 21 which has been formed in complementation to area 16 of ring 13. In the inside of the pipe sections 8, 9, there are additional rings 22, 23 for the centering of inside pipe 10.

The pipe sections, 8, 9, and the inside pipe 10, consists preferably of aluminum with a wall thickness of, for example about 1.8 mm. The diameter of the mast 4 amounts for example to 100 to 150 mm. The length of the inside pipe 10 amounts for example, to 800 to 1000 mm. The rings 13, 18, 22 and 23 may be forgings or castings; they may also be made of plastics.

In case of an assembly of the mast, inside pipe 10, carried by the upper pipe section 8, or ring 13, is introduced into the inside of the lower pipe section 9. In order to make this introduction easier, there should be relatively great play between the outside diameter of the inside pipe 10 and the inside diameter of ring 18. The introduction of the inside pipe 10 is terminated whenever the rings 13 and 18, to be more precise, the areas 16 and 21 of these rings become engaged. By the complementary development of these areas, the pipe sections 8, and 9 are aligned precisely in a simple manner. Since the the rings 13, and 18 accomplish the precise alignment of the pipe sections 8 and 9, these rings must have only very slight production tolerances in regard to their diameter, for example, 0.2 mm in case of the above general dimensions of the mast. These slight production tolerances, in the case of these rings, may however, be maintained very much more easily, than for example, in case of the inside pipe 10, which in case of known collapsible masts is directly responsible for the alignment of the pipe sections and therefore must have correspondingly low production tolerances.

This, however, is hardly possible in case of inside pipes with a diameter of for example, more than 60 mm, as needed absolutely for catamarans. Contrary thereto, the inside pipe 10 in case of the present mast structure may have considerably higher production tolerances with respect to the diameter for example, up to 1.5 mm, in case of the above general dimensions of the mast. The mast assembled thus, has a positive connection between the pipe sections 8, and 9 which can easily cope with all stresses of the catamaran and which is made up by positive connection by way of rings 13, and 18 and the inside pipe 10. Sand, or other foreign substances, which possibly penetrate into the spaced between the inside pipe 10 and the pipe sections 8 and 9 especially during assembly of the mast will cause no damage whatever, or jammings of parts of the mast, because of the radial dimensions of this space in case of the existing mast structure.

COUPLING OF SHROUDS, STAYS ETC.

FIG. 3 shows a hook 25, preferably of aluminum and attached for example, by welding at the front side 24 of the mast 4. The shrouds, 5, the head stay 6, trapezoidal wires (not shown), etc., may be attached to this hook 25 in a simple manner with the help of a ring 26 or of other arrangements, such as shackles etc., that may be connected with the hook.

FIG. 4 illustrates an anchor plate 27 with an oblong hole 28, attached to a hull 1. The end of the shroud 5 is connected for example, by mutual compression with a hollow construction unit 29, at the other end of which and transversely to the longitudinal direction of the shroud 5 and of the hollow construction unit 29 a bar-shaped, angulated "T" endpiece 30, for example a forging, is attached. The shroud 5 may be attached torsionally to the anchor plate 27, in a simple manner without danger of injury to the operator, and without any risk of the loss of construction units, by guiding the "T" endpiece 30 through the oblong hole 28 and turning it subsequently by 90°.

CROSS BEAMS

FIG. 5 shows the wedge-shaped profile of the crossbeam 2, consisting preferably of aluminum, whereby the left side "L", e.g. the thinner edge of the wedge shape of the profile is shown in the direction of travel of the catamaran. This profile is accommodated at both its ends without additional means in recesses of the hull 1 and is braced in these recesses by means of compression forces of the mast 4 engaging eccentrically at the right side of the profile shown in FIG. 5 along the arrow 31, e.g. the "thick back" of the wedge shape. A great strength of the catamaran will be achieved hereby. For example, grooves 32, 33, and 34 for the attachment of the trampolin and of runner for sheets are provided in a known manner.

Figure 6:
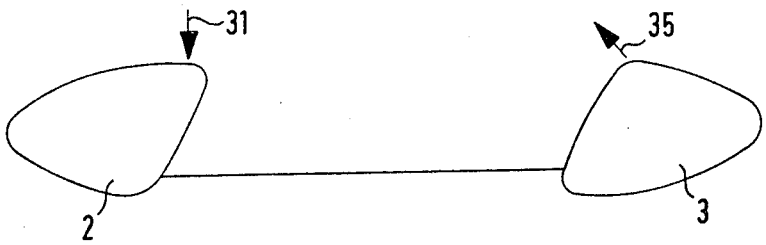
FIG. 6 is a schematic presentation of the forward and rear crossbeam and of the compression and tension forces attacking at said crossbeams.
Figure 7A:
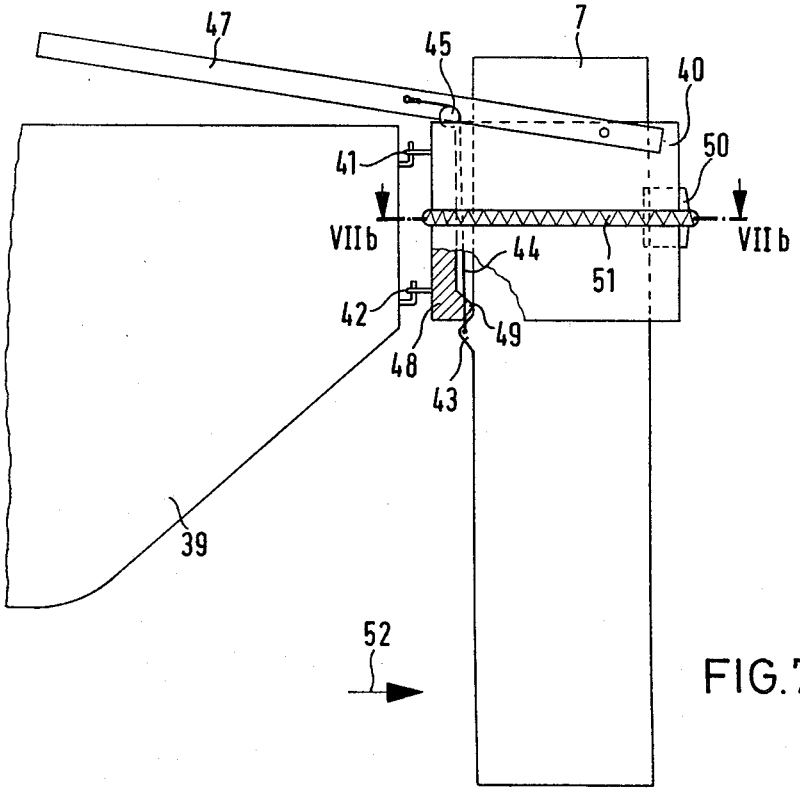
FIG. 7*a* is an enlarged, partly broken away, schematic side view of the arrangement of the rudder blade, shown in the dash-dot circle VII in FIG. 1.
Figure 7B:
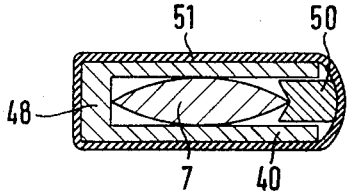
FIG. 7*b* shows a cut along line VII*b*—VII*b* in FIG. 7*a*.

As shown schematically in FIG. 6, the same profile is used in a simple manner for the rear crossbeam 3 as for the forward crossbeam 2, whereby the rear crossbeam 3 is rotated by about 180° around its horizontal longitudianl axis in relation to the forward crossbeam 2.

Figure 1:
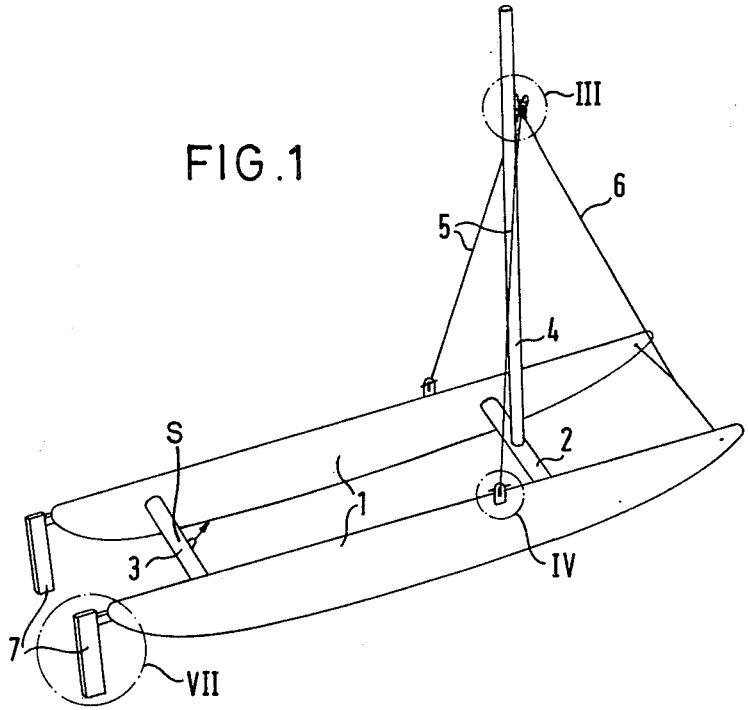
FIG. 1 shows a schematic and perspective illustration of a catamaran as in the present invention.

The tension forces of the main sail sheet S(shown in FIG. 1) engaging in the direction of the arrow 35 are in the same order of magnitude as the compressive forces of the mast 4, engaging in the directional arrow 31, and they take care of an additional bracing of the cross-beams in the hulls, whereby a balanced distribution of the forces engaging on the catamaran to the various construction units is achieved without load-peaks.

RUDDER ASSEMBLY

FIGS. *7a* and *7b* illustrate schematically the support of the rudder blade 7. The rudder blade 7 comprises an extruded main body, preferably of aluminum, whereby the extruded piece may consist of a hollow body with one or several chambers or of a solid body. The strand emerging from the matrix, provided with the desired profile, is merely subdivided by cross cuts, i.e., by cuts running perpendicularly or transversely to the direction of the strand, corresponding to the desired length of the rudder blade, for example, about 750 mm. The production of rudder blades according to the invention by the extrusion process, reduces the cost of these parts to 1/5 to 1/10 of the cost occuring in case of the known parts. Beyond that the rudder blades produced according to the invention are considerably more insensitive to mechanical loads, which increases the safety of the boat and the useful life of these parts considerably.

It will be advantageous to cover up the upper end of the rudder blades according to the invention with caps, preferably plastic, in order to prevent the development tip-votexes during operation of the boat, which could impede the functioning of the rudder blade. In the case of hollow rudder blades, the ends may also be welded shut advantageously with a lid. Beyond that, the wall parts of the upper and lower ends of hollow rudder blades may be compressed transversely to the direction of extrusion and may be interconnected, for example, by welding, gluing etc., Other blades too, such as for example, swords, etc., of catamarans or other sailboats may be produced from one extruded piece.

The rudder blade 7 is guided in a rudder housing 40, which is attached by way of hinges 41, and 42 to a hull 1 and is mounted swivellably around the hinges. A projection 43 is developed on the front face of the rudder blade 7. A strip of elastic 44 is fastened releaseably to this projection 43, which is guided by way of a roller 45 provided on the rudder housing 40 or, by way of a shoulder on said rudder housing and is connected with a tiller 47 to thereby constitute means to bias rubber blade 7 in a vertical direction. The tiller 47 is attached to a lateral wall of the rudder housing 40 and may be bifurcated for attachment to both sidewalls of rudder housing 40. At the lower end of the reverse side of the front wall 48 of the rudder housing 40, an abutment or cam 49 has been provided. This cam 49 is mounted swivellable around a horizontal axis, if desired, which is not shown in detail. A slight distance from the reverse side of the rudder blade 7, a guide element in the form of a block 50 has been disposed, which is attached for example, by adhesive means, to an elastic strip 51. Instead of the block 50, a roller or something similar may also be provided. The rubber strip 51 is placed around the rudder housing 40 and prestresses or biases the block 50 in the direction of travel of the catamaran.

During the mounting of the rudder blade, one precedes as follows:

The projection 43 on the rudder blade 7 is connected with the rubber strip 44, and the rudder blade is introduced into the rudder housing 40. The projection 43 is guided past the cam 49 either by pressure or by turning away of the cam 49, for example by means of a line (not shown), whereby the rudder blade 7 is deflected counter to the elastic prestress of the block 50 or of the rubber strip 51 somewhat to the back. Whenever the projection 43 reaches behind the cam 49 in the position shown in FIG. *7a*, than the rudder blade is connected positively with the rudder housing 40 by the tension of the elastic strip 44, so that a perfect steering process will be guaranteed. The hauling in of the rudder blade 7 takes place through the fact that the cam 49 is turned away and the rudder blade 7 is pulled up.

In the case of standard loads of the rudder blade 7, a movement of the rudder blade rearwards is prevented by the block 50. Whenever the rudder blade is exposed however, to extreme, unintentional stresses, for example, acting in the direction of arrow 52, in case of running aground, which normally may lead to a breaking of said rudder blade, the block 50 is pushed backward, so that the projection 43 may glide over the cam 49 and the rudder blade is pulled automatically upward by the pre-tensioned rubber strip 44.

As a result of the automatic vertical adjustability of the rudder blade 7, and differing from the customary tiltability of said rubber blade upward around a horizontal axis, a perfect steering process may be guaranteed ever in shallow waters, since even in case of a rudder blade pulled up partly, a sufficient rudder blade surface is still available with an unchanged lever-arm in relation to the rotational axis made-up by the hinges 41 and 42. The positive linkage between the rudder blade 7 and the rudder housing 40 is still sufficient in order to guarantee a safe steering process, even if the rudder blade has been partly pulled up, i.e., therefore whenever the projection 43 and the cam 49 no longer are in engagement. As the result of a special development of the hulls 1, which in particular solves the problems of the lateral law with correspondingly deep-drawn rear section 39 of the hulls 1, the catamaran will remain maneuverable without problems in case of a rudder blade 7 pulled partly vertically upwards, up to the design limit of the hulls 1.

THE HULLS

Figure 8:
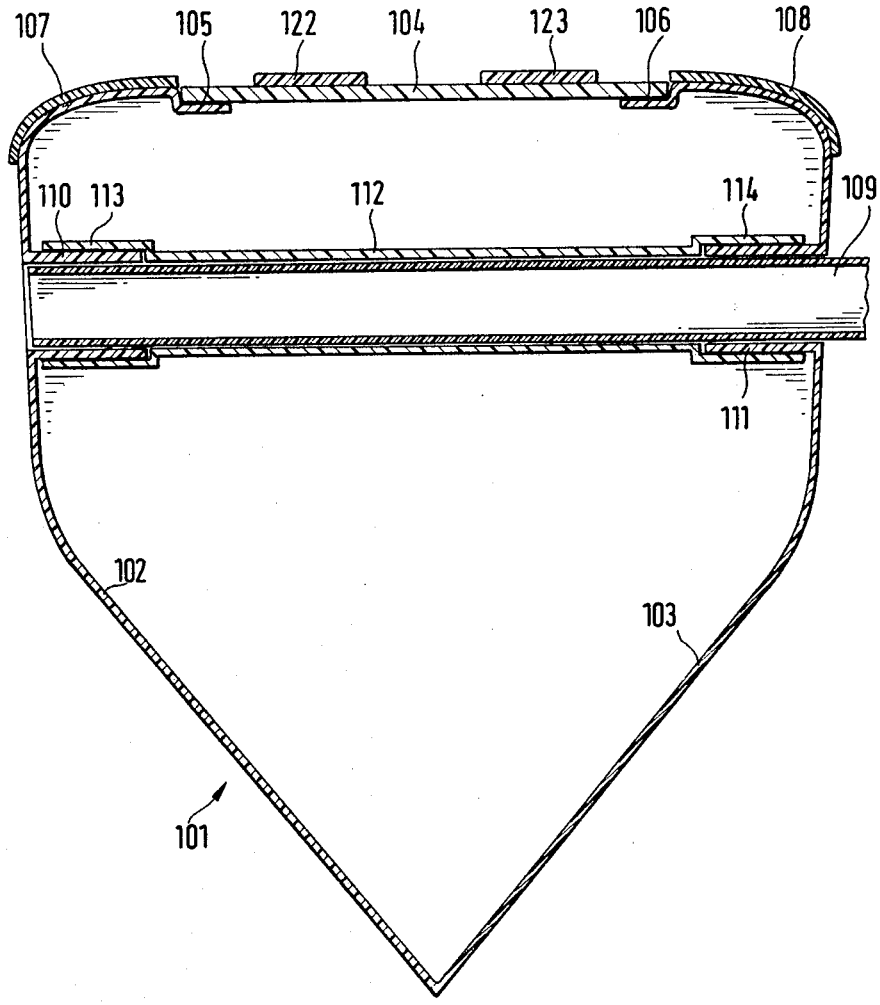
FIG. 8 shows a schematic cross-section through a hull in the area of the crossbeam mounting.

FIG. 8 shows a hull 101, which includes two lateral parts 102, 103 integrally molded together and a one piece cover 104. The lateral parts 102, 103 and the cover 104 consist preferably of glass-fiber-reinforced polyester. The cover 104 is glued together with the lateral parts 102, 103 in the continous shoulder areas 105, and 106. In case it is desired, other methods may also be used for connecting the cover with the lateral parts. The visible joint abutments between the cover 104 and the lateral parts 102, and 103 are in alignment with the edge of antislip strips 107, and 108 as a result of which the outside appearance of the hull will be even more attractive and compact. Additional anti-slip strips 122, 123 are disposed on the cover 104.

The lateral parts 102, 103 have integrally formed collars 110, 111, with cross-sectional profiles adapted to the profile 109 of the crossbeams and directed into the inside of the hull 101 which (profiles) are developed in one piece with the lateral parts and serve for the guidance and mounting of the crossbeam 109. In order to ensure the waterproofing of the reception of the crossbeams in regard to the inside of the hulls, the profiles 110, 111 of the lateral parts 102, 103 are interconnected by an inside tubular members 112, having enlarged ends of the inside or enlargements 113, 114 which have cross sectional profiles which collars 110 and 111.

Figure 9:
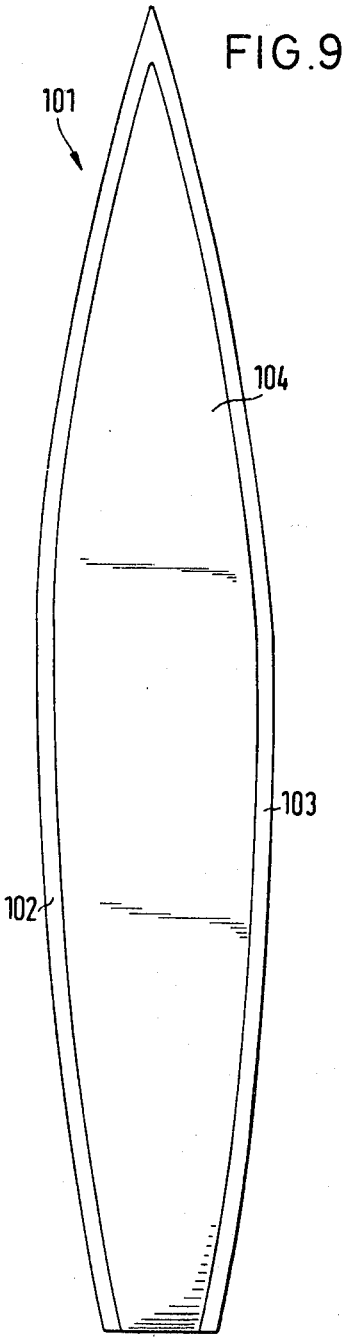
FIG. 9 is a schematic top view of a hull.

From the schematic top view of FIG. 9 it becomes clear that the cover 104 is made of one piece, countrary to the known covers, which because of the mounting of the crossbeams are developed in three parts in the longitudinal direction. The anti-slip-strips have been omitted in this illustration.

Figure 10:
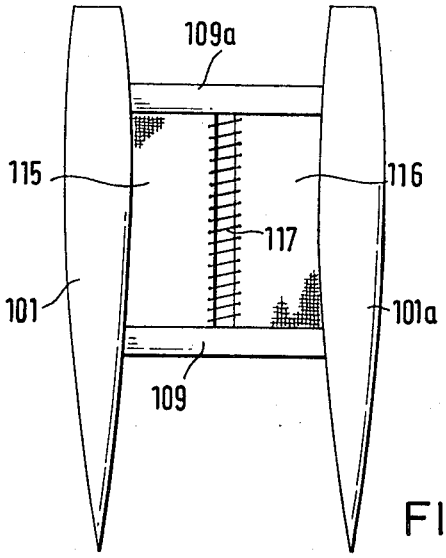
FIG. 10 is a schematic top view of the basic structure of the catamaran consisting of the hulls, the crossbeams and the trampolin.

FIG. 10 shows two hulls 101, and 101*a*, two crossbeams 109, 109*a* and a trampolin consisting of two parts 115, 116, schematically. As a result of the central lacing 117, of the two parts 115, 116 of the trampolin, which for example, are framed by means of bolt ropes both at the hulls 101, 101*a* as well as at the crossbeams 109, 109*a*, the hulls 101, 101*a* are prestressed against an undesirable movement from outside, i.e., in cross direction. The prestress of the trampolin parts and thus of the hulls in cross direction may also be accomplished in eccentric longitudinal directions of the trampolin.

Figure 11:
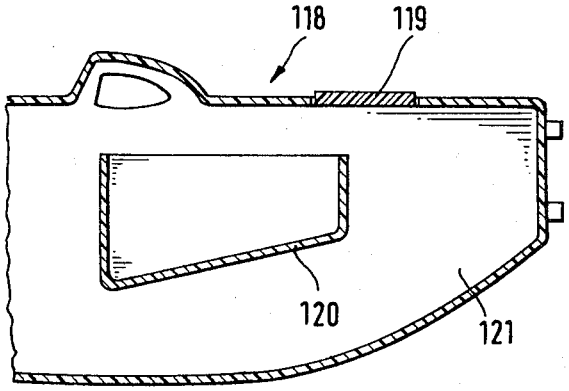
FIG. 11 shows a schematic longitudinal cut through the rear end of a hull.

FIG. 11 shows the rear part 118 of a hull. A box 120, in which for example, personal effects may be stored, and whch fastened in the inside of the hull, may be reached by one's hand by way of an opening equipped with a lid 119. By storing articles in the box 120, a slipping of these articles in the hull will be prevented. The lid 119 has been positioned such, that at the same time, the rearward, inside terminal section 121 of the hull may be reached for pumping water out by hand.

While there has been shown and described a preferred embodiment of the invention which achieve the objects advantages and features of the invention, it will be appreciated that man adaptations and modifications of the invention will be obvious to those skilled in the art which obvious adaptations and modifications are intended to be encompassed by the claims appended hereto.

What is claimed is:

1. In a catamaran having a mast a main sail sheet and a pair of spaced hulls and means joining said hulls together, a head stay and shrouds for maintaining said mast vertical, improvement in the means joining said hulls together comprising, fore and aft cross beams, each cross beam having, the same wedge-shaped profile, the wedge-shaped profile having a thinnest edge and a thicker back, the thinnest edge of the wedge shape of the fore cross beam being essentially forwardly directed, the thinnest edge of the wedge of the aft cross beam being essentially aftwardly directed by rotating the aft cross beam by 180° as compared to the fore cross beam, means forming correspondingly shaped fore and aft sockets in said hulls for receiving the respective ends of said cross beams, said mast being centrally stepped aftwardly on the thicker back of said forward cross beam so that said forward cross beam will receive a downward compression force bracing the fore cross beam in the fore sockets, said main sail sheet being connected to the aft cross beam so that said aft cross beam will receive upward tension forces, bracing additionally the cross beam in the aft sockets, whereby a balanced distribution of the forces engaging on the catamaran is achieved without load peaks.

2. A catamaran as defined in claim 1, wherein said mast includes lower and upper tubular mast sections, an inner pipe member entering said lower and upper mast sections, a pair of complementarily shaped nesting rings, the complementary shape of said nesting rings being adapted to permit one ring to nest within the other, one of said nesting rings being secured on the upper end of said lower mast section and the other of said nesting rings being on the lower end of the upper mast section, one of said nesting rings being secured to said inner pipe member and the upper one of said mast sections, and the other of said nesting rings being secured to said lower mast section, which nesting rings establish a precise alignment and linkage between said two mast sections guided by said inner pipe.

3. A catamaran as defined in claim 2, wherein said nesting rings are adapted to be put into positive mutual engagement and are always received in at least a forcefit at the corresponding end of their respective mast sections.

4. A catamaran as in claim 2 including additional rings disposed inside each said lower and upper mast sections for centering said inner pipe member.

5. A catamaran as defined in claim 1, including a hook, and means securing said hook to a forward portion of said mast, small ring means on the respective ends of said shrouds and said head stay, a larger ring engaged with all of said small rings and suspended in said hook.

6. A catamaran as defined in claim 1 having a rudder means, said rudder means including a rudder housing, a tiller handle secured to said rudder housing, a vertically shiftable rudder blade in said rudder housing, an elastic element under tension and connected between a point on said rudder housing and said rudder blade for automatically moving said rudder blade in a vertical direction in said rudder housing upon said rudder blade impacting a surface or object below the water surface.

7. A catamaran as defined in claim 6 wherein the point on said rudder housing is the tiller, said elastic element is an elongated rubber element, which is guided to said point by way of a curved surface on said rudder housing.

8. A catamaran as defined in claim 7 including a projection on the forward edge of said rudder blade, a cam mounted on the rudder housing engagable with said projection on said rudder blade said rudder blade being swivellable around a horizontal axis upon said rudder blade impacting a surface or object to disengage said projection from said cam.

9. A catamaran as defined in claim 8 including a guide element, said guide element being elastically prestressed in the direction of travel of the catamaran, said guide element being provided at a slight distance from the rear end of the rudder blade, which guide element is elastically prestressed with the help of a further elastic element to which it is attached, and which is guided around said rudder housing.

10. A catamaran as defined in claim 6 wherein said rudder blade comprises an extrusion molded aluminum member.

11. Catamaran as defined in claim 6 wherein the rudder blade and the longitudinal profile of the hulls are mutually synchronized such that the good maneuverability of the catamaran exists even in shallow waters as a result of the vertical adjustability of the rudder blade.

12. In a catamaran having at least a pair of spaced hulls the improvements wherein each of said hulls comprise a flat, one-piece fiber glass cover plate, two lateral fiber glass parts joined at their lower edges to form a V and having integral shoulders at their top sides which are interconnected by said flat one-piece cover at their top side, fore and aft wedge shaped beams joining said hulls, each said wedge shaped beam having a thin edge and a thick back with the thin edge of said fore beam being essentially forwardly directed and with the thin edge of said aft beam being essentially aftwardly directed, each hull having fore and aft transverse recesses, each recess being directed into the inside of the hull and adapted always to the profile of an associated wedge shape cross beam and is developed in one piece with said lateral parts for guidance and mounting of said fore and aft wedge shaped cross beams.

13. A catamaran as in claim 12 characterized in that two mutually aligned recess profiles of said two lateral parts directed into the inside of the hull body are interconnected by an inside profile which always encompasses the profiles of the lateral parts with one enlarged end of the inside profile.

14. A catamaran as defined in claim 12 including anti-slip strips on the top of the hull, whereby the two visible joints between the cover and said lateral parts are always aligned with the edges of said anti-slip strips.

15. A catamaran as defined in claim 12 wherein in the rear part of at least one of said hulls, a separate box is disposed, whereby the box and the rear, inside terminal section of the hull may be reached by way of a closable aperture in the cover.

16. A catamaran as defined in claim 12, including a trampolin, characterized in that said trampolin consists of two parts, each said trampolin part secured to a hull, respectively, and means firmly securing the forward and trailing edges of each trampolin part to said cross beams, respectively, lacing for mutually tightening said two trampolin parts in transverse direction to prestress said hulls against movement in a cross direction.

17. In a collapsible hollow mast for sailboats in which a continuous groove or slot for guiding the raising and lowering of the sail is provided along a side of said mast, said mast being constituted by at least one hollow upper mast section and one hollow lower mast section, improvement in the means for joining said upper mast section to said lower mast section without requiring critical tolerance of the individual parts of the mast and without reducing strength of the mast comprising, a first nesting ring secured within the upper end of said hollow lower mast section, said nesting ring having a curved surface, a second nesting ring secured within the lower end of said at least one hollow upper mast section, said second nesting ring having complementarily curved surfaces adapted to mate with said curved surface of said first nesting ring, the curved surface of one of said nesting rings being an inward arched concave area with the curved surface on the other of said nesting rings being complementary thereto, and ;

a hollow inner tube telescoped within said at least one hollow upper mast section and sealingly secured therein to said second nestng ring, and having an end projecting beyond the lower end of said hollow upper mast section and through said first nesting ring.

18. The collapsible mast defined in claim 17 wherein each said nesting ring includes a flange member having flat mating surfaces outwardly of said complementarily curved surfaces.

19. In a catamaran having a pair of spaced hulls, fore and aft cross beam means spacing said hulls apart, a mast stepped on said fore crossbeam, a main sail sheet, and at least one rudder, the improvement in said mast as defined in claim 17.

20. The invention defined in claim 19 wherein said cross beam means are wedge shaped in cross section, each said hull having fore and aft transverse recesses, each recess receiving one end, respectively, of said wedge shaped cross beams, the forward cross beam being turned about its axis approximately 180° relative to said aft cross beam whereby the compression stresses of the forward cross beam by the mast stepped thereon and the tension load of said aft cross beam by the main sail sheet fixed thereon is a balanced distribution of the loads occurring during sailing.

21. A rudder assembly for a sailboat comprising:

a rudder housing, means for swivellably mounting said rudder housing on a sailboat, a rudder blade, means guiding said rudder blade in said rudder housing for vertical movement therein, a tiller handle secured to said rudder housing and means releasably positioning said rudder blade in said rudder housing at at least one selected vertical position, said means releasably positioning including, a first abutment on said rudder housing and a second abutment on said rudder blade for engaging said first abutment, a first biasing means connected between said blade and said rudder housing biasing said rudder blade to move in a vertical direction when said abutments are disengaged, and a second biasing means biasing said rudder blade in a forward direction, whereby when said rudder blade encounters an obstruction and is moved against the bias of said second biasing means to disengage said abutments said first biasing means moves said rudder blade in an upward vertical direction.

22. The rudder assembly defined in claim 21 wherein said rudder blade is extruded aluminum.

23. The rudder assembly defined in claim 21 wherein said guide means includes a guide element engaging the trailing edge of said rudder blade, said second biasing means prestressing said guide element in the direction of travel of said sailboat.

24. The rudder assembly defined in claim 23 wherein said first biasing means includes an elongated elastic element secured at one end to said rudder blade and at the opposite end to said tiller handle, said tiller handle constituting the connections to said rudder housing.

25. The rudder assembly defined in claim 24 including a roller on said rudder housing, said first biasing means being guided by said roller.

26. In a catamaran having at least a pair of spaced hulls joined by at least fore and aft cross beams, a sail on a mast stepped on said fore cross beam, and a main sail sheet, the improvement wherein said cross beams are generally wedge shaped and identical in cross section, each having a thin edge and a thick back, and said hulls having corresponding wedge shaped transverse recesses into which said fore and aft cross beams are received, the wedge shape of said fore cross beam being oriented about its axis to carry a compressive load from said mast such that its thin edge is forward and its thick back is aftward, said mast being stepped on said thick back, and said aft cross beam being oriented about its axis to carry tension forces of the main sail sheet from its thick back to thereby provide a substantially balanced distribution of forces engaging said catamaran.

27. The catamaran defined in claim 24 wherein each said hull is identical and constituted by an integrally molded pair of lateral side parts, which side parts meet at their lower ends to form a "V" shape for said hull, and curve inwardly at their upper ends to a continuous shoulder sections, a cover plate secured to said lateral side parts at said upper ends continuous shoulder sections, said wedge shaped transverse recesses including inwardly turned, aligned collars molded in said lateral side parts, each collar having a cross-sectional profile corresponding to that of said cross beams, and an internal tubular member having the same cross-sectional profile, and an enlargement on each end of said tubular members fitted onto said inwardly turned collars.

28. The catamaran as defined in claim 27 wherein the rear sections of said hulls are deep drawn.

* * * * *